US005690798A

United States Patent [19]

Alexander et al.

[11] Patent Number: 5,690,798

[45] Date of Patent: Nov. 25, 1997

[54] CORNER PROTECTOR FOR ELECTROWINNING ELECTRODE

[75] Inventors: Graeme Alexander; Manuel G. Santoyo, both of Tucson, Ariz.

[73] Assignee: Quadna, Inc., Tucson, Ariz.

[21] Appl. No.: 607,183

[22] Filed: Feb. 26, 1996

[51] Int. Cl.[6] ..... C25D 17/00

[52] U.S. Cl. ..... 204/279; 204/281

[58] Field of Search ..... 204/279, 281; 29/623.5

[56] References Cited

U.S. PATENT DOCUMENTS

| | | | |
|---|---|---|---|
| 3,798,151 | 3/1974 | Takamura et al. | 204/281 |
| 3,804,724 | 4/1974 | Bolger et al. | 204/281 X |
| 4,776,928 | 10/1988 | Perlich | 204/281 X |
| 5,314,600 | 5/1994 | Webb et al. | 204/281 X |

FOREIGN PATENT DOCUMENTS

| | | | |
|---|---|---|---|
| 0582335 | 11/1977 | U.S.S.R. | 204/281 |
| 0584058 | 12/1977 | U.S.S.R. | 204/281 |

*Primary Examiner*—Donald R. Valentine
*Attorney, Agent, or Firm*—Antonio R. Durando

[57] ABSTRACT

An electrode assembly for use in electrowinning includes a cathode in the form of a plate. The cathode has a pair of parallel vertical edges, and a horizontal bottom edge which runs between the vertical edges and defines respective corners therewith. An edge strip is mounted on each of the vertical edges as well as on the bottom edge. The bottom edge strip has an end at either corner, and each end of the bottom edge strip is in abutment with the lower end of the adjoining vertical edge strip. A corner protector is located at each corner and has a vertical channel which receives the lower end of the respective vertical edge strip, a horizontal channel which receives the respective end of the bottom edge strip, and a cutout which receives the cathode.

20 Claims, 1 Drawing Sheet

CORNER PROTECTOR FOR ELECTROWINNING ELECTRODE

BACKGROUND OF THE INVENTION

1. Field of the Invention

The invention relates to an electrode assembly for use in electrolytic processes.

2. Description of the Prior Art

Electrowinning is an electrolytic process in which metallic ions, e.g., copper ions, are recovered from an electrolyte using anodes and cathodes in the form of generally rectangular plates. A large number of anodes and a large number of cathodes are suspended in the electrolyte vertically with the anodes and the cathodes alternating. The cathodes are generally made of titanium, copper alloys or stainless steel, and the metallic ions deposit on the cathodes and coat them with sheets of pure metal. When the deposited sheets reach a certain thickness, the cathodes are removed from the electrolyte and the sheets stripped from the cathodes.

If deposition is allowed to occur at the edges of a cathode, metallic bridges are formed between the deposited sheets on either side of the cathode. These metallic bridges, which wrap around the edges of the cathode, make it difficult to strip the deposited sheets without damaging the sheets and/or the cathode.

To alleviate this problem, nonconductive strips known as edge strips or protector strips are placed over the submerged bottom and side edges of the cathode. The edge strips are normally bonded to the cathode with glue or adhesive tape. In addition to inhibiting the formation of metallic bridges, the edge strips function to prevent direct contact between the cathode and the adjacent anodes.

At the lower corners of a cathode, the edge strips at the sides of the cathode define junctions with the edge strip at the bottom of the cathode. Glue is applied to these junctions to prevent penetration of the electrolyte into, and an accompanying deposition of metal around, the junctions. However, over time, the glue develops cracks which permit leakage of the electrolyte into the junctions. Eventually, the edge strips must be removed to allow cleaning of the cathode. The process of removing the edge strips, cleaning the cathode and replacing the edge strips is a time-consuming one which also keeps the cathode out of service.

In order to further reduce the likelihood of electrolyte penetration into a junction, the edge strips should fit together tightly at the junction. This requires precision finishing of the edge strips and accurate positioning of the edge strips on the cathode so that the manufacturing time, as well as the time required to mount the edge strips on the cathode, is increased.

To obtain a better fit, the edge strips are sometimes mitered, which also increases manufacturing and installation time.

SUMMARY OF THE INVENTION

It is an object of the invention to provide an article which enables the intervals between cleanings of an electrolytic electrode to be increased.

Another object of the invention is to provide an article which makes it possible to reduce the time required to cover the edges of an electrolytic electrode.

An additional object of the invention is to provide an electrolytic electrode assembly which allows longer intervals to elapse between electrode cleanings.

A further object of the invention is to provide an electrolytic electrode assembly which permits the edges of an electrode to be covered more rapidly.

One more object of the invention is to provide a method of making an electrolytic electrode assembly which enables an electrode to operate for longer periods of time without cleaning.

Yet another object of the invention is to provide a method of making an electrolytic electrode assembly which makes it possible to cover the edges of an electrode more quickly.

The preceding objects, as well as others which will become apparent as the description proceeds, are achieved by the present invention.

One aspect of the invention resides in a corner protector for an electrolytic electrode having first and second edges which define a corner and are respectively provided with first and second coverings, e.g., edge strips. The corner protector comprises a body provided with a first channel portion for receiving the first covering, a second channel portion for receiving the second covering, and a cutout for receiving the electrode.

The corner protector of the invention is designed to serve as a shield for the corner of an electrode and for the adjacent portions of coverings on the edges of the electrode. The corner protector retards leakage or seepage of electrolyte to the corner and to the adjacent portions of the coverings so that less frequent cleaning of the corner area is required. The corner protector also serves as a shield against physical abuse and therefore lessens the chances of damage from such abuse. Furthermore, because of the shielding effect of the corner protector, the coverings for the two edges which define the corner need not fit together tightly. Hence, the coverings do not have to be finished with a high degree of precision. In addition, it is not necessary to position the coverings on the electrode with great accuracy thereby allowing the coverings to be mounted on the electrode relatively rapidly.

Another aspect of the invention resides in a method of making an electrolytic electrode assembly. The method comprises the steps of providing an electrode having a first edge, and a second edge which defines an intersection with the first edge; placing a first covering having a first end over the first edge so that the first end is in the region of the intersection; placing a second covering having a second end over the second edge so that the second end is in the region of the intersection; and confining the first end, the second end and the intersection in an additional covering.

The confining step may include gripping the electrode with the additional covering. The confining step may likewise comprise gripping the first and second ends with the additional covering.

The placing steps can involve abutting the ends of the coverings against one another.

The method can further comprise the step of adhesively connecting the additional covering to the electrode and to the ends of the coverings.

Further features and advantages of the invention will be forthcoming from the following detailed description of preferred embodiments when read in conjunction with the accompanying drawings.

DESCRIPTION OF THE PREFERRED EMBODIMENTS

Figure 1:
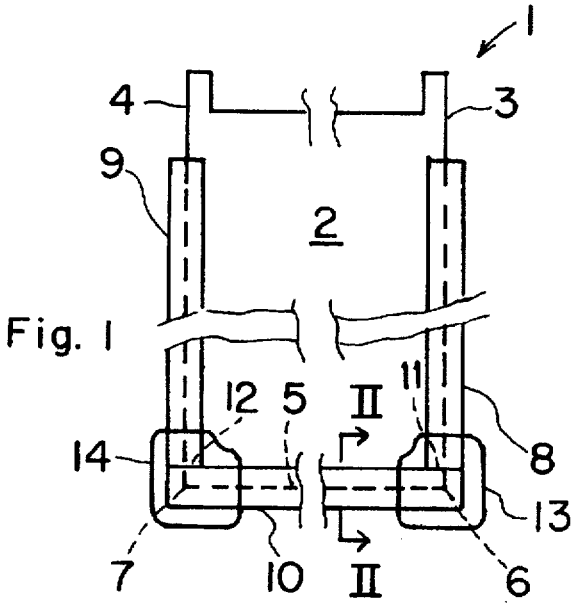
FIG. 1 is a front view of a schematic representation of an electrolytic electrode assembly in accordance with the invention, shown in cut-out portions for convenience of scale.

Referring to FIG. 1, the numeral 1 generally identifies an electrode assembly according to the invention. The electrode assembly 1 is designed for use in an electrolytic process and is particularly well-suited for electrowinning. In operation, the electrode assembly 1 is suspended in an electrolyte together with other electrode assemblies.

The electrode assembly 1 includes an electrode 2 which is here assumed to be a cathode for an electrowinning apparatus. The cathode 2 may be made of any material conventionally employed for electrowinning such as a copper alloy, titanium or stainless steel. The cathode 2 has a pair of opposed vertical side edges 3 and 4 as well as a horizontal bottom edge 5. The bottom edge 5 and the side edge 3 define a lower corner 6 of the cathode 2 whereas the bottom edge 5 and the side edge 4 define a lower corner 7 of the cathode 2. When the electrode assembly 1 is suspended in an electrolyte, the bottom edge 5 and all but the uppermost portions of the side edges 3,4 are submerged.

Figure 2:
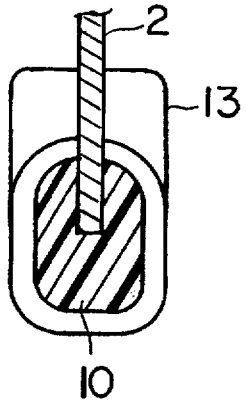
FIG. 2 is a fragmentary sectional view in the direction of the arrows II—II of FIG. 1.

The submerged portion of the side edge 3 is provided with a covering 8 while the submerged portion of the side edge 4 is provided with a covering 9. Similarly, the submerged bottom edge 5 is provided with a covering 10. The coverings 8,9,10, which can be constituted by conventional edge strips or edge protectors, function to prevent deposition at the edges 3,4,5. The edge strips 8,9,10 all have the same cross-sectional shape and the same cross-sectional area. A cross section of the edge strip 10 is shown in FIG. 2.

The bottom edge strip 10 abuts the side edge strip 8 at a junction line or juncture 11 near the corner 6 of the cathode 2. Likewise, the bottom edge strip 10 abuts the side edge strip 9 at a junction line or juncture 12 near the corner 7 of the cathode 2.

If the electrode assembly 1 were conventional, the electrode assembly 1 would be placed in service after adhesively securing the bottom edge strip 10 to the side edge strips 8,9 along the junction lines 11,12. The adhesive at the junction lines 11,12 would then function as the sole barrier to penetration of the junction lines 11,12 by electrolyte and to the resultant electrolytic deposition in and around the corners 6,7. However, since the adhesive is exposed to the rather harsh environment existing in an electrolytic processing installation, the adhesive would deteriorate and develop cracks rather quickly. Consequently, electrolyte would seep through the adhesive and electrolytic deposition would take place in and around the corners 6,7. After a relatively short operating period (typically about 6 months), the edge strips begin separating at the corners and require periodic repair in order to ensure a full service life (typically 2 to 3 years); after that, the edge strips 8,9,10 have to be removed, the cathode 2 cleaned and the edge strips 8,9,10 replaced. These operations are time-consuming and expensive.

Figure 3:
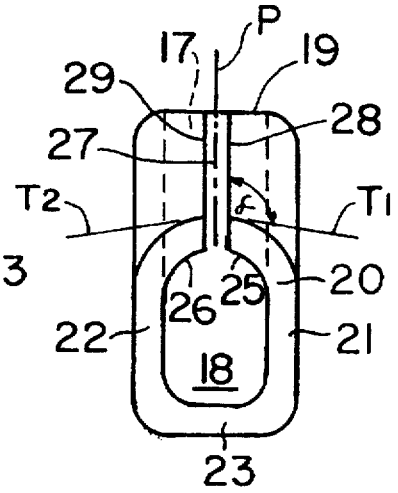
FIG. 3 is an end view of a corner protector constituting part of the electrode assembly of FIG. 1.

According to the invention, the junction lines 11,12 are shielded or protected by corner protectors 13 and 14, respectively. Each of the corner protectors 13,14 fits over one of the corners 6,7 and is designed to receive and grip one end of the bottom edge strip 10, the adjoining end of the side edge strip 8 or 9, and a portion of the cathode 2 near the junction line 11 or 12. The corner protectors 13,14 are identical and will be described with reference to FIGS. 3 and 4 which show the corner protector 13.

The corner protector 13 is in the form of a generally L-shaped body which is of one piece and has a pair of short legs 15 and 16. The leg 15 is vertical and the leg 16 horizontal so that the legs 15,16 are perpendicular to one another. The corner protector 13 is provided with a channel or channel portion 17 which extends along the leg 15 and has a longitudinal axis A. The corner protector 13 is further provided with a second channel or channel portion 18 which extends along the leg 16 and has a longitudinal axis B. The channels 17,18 are normal to one another, and the longitudinal axes A,B intersect each other at an angle of 90 degrees. The channels 17,18 meet internally of, and together define a continuous, right-angled passage through, the corner protector 13.

The channel 17 is designed to receive the end of the side edge strip 8 which adjoins the bottom edge strip 10, and the channel 17 has the same cross-sectional shape as the side edge strip 8. Moreover, the cross-sectional area of the channel 17 equals or approximates that of the side edge strip 8. Similarly, the channel 18 is designed to receive the end of the bottom edge strip 10 which adjoins the side edge strip 9, and the channel 18 has the same cross-sectional shape as the bottom edge strip 10. Further, the cross-sectional area of the channel 18 equals or approximates that of the bottom edge strip 10.

The leg 15 has a flat end face 19 which lies in a plane perpendicular to the longitudinal axis A of the channel 17, and the channel 17 has an opening in the end face 19. Likewise, the leg 16 has a flat end face 20 which lies in a plane perpendicular to the longitudinal axis B of the channel 18, and the channel 18 has an opening in the end face 20. The opening of the channel 17 and the opening of the channel 18 are thus located in orthogonal planes.

The corner protector 13 includes a pair of opposed flat side walls 21 and 22 which are parallel to one another and bound the channels 17,18 laterally. The corner protector 13 further has a flat bottom wall 23 which is perpendicular to the longitudinal axis A of the channel 17, and the corner protector 13 also has a flat rear wall 24 which is perpendicular to the longitudinal axis B of the channel 18. The intersections of the bottom wall 23 and the side walls 21,22 are preferably rounded externally of the corner protector 13 as is the intersection of the bottom wall 23 and the rear wall 24. Similarly, the bottom wall 23 merges into the end face 20 via an externally curved surface while the rear wall 24 merges into the end face 19 by way of an externally curved surface.

The corner protector 13 has a divided top wall which comprises a first section 25 extending from the upper end of the side wall 21 and a second section 26 extending from the upper end of the side wall 22. The wall sections 25,26 cooperate to define a cutout or opening 27 which is in the form of a slot and passes through the top wall from the exterior of the corner protector 13 to the channels 17,18. The cutout 27 extends from the channel opening in the end face 19 to the channel opening in the end face 20. The cutout 27 is designed to receive a portion of the cathode 2 in the region of the junction line 11, and the width of the cutout 27 equals or approximates the thickness of the cathode 2.

Figure 4:
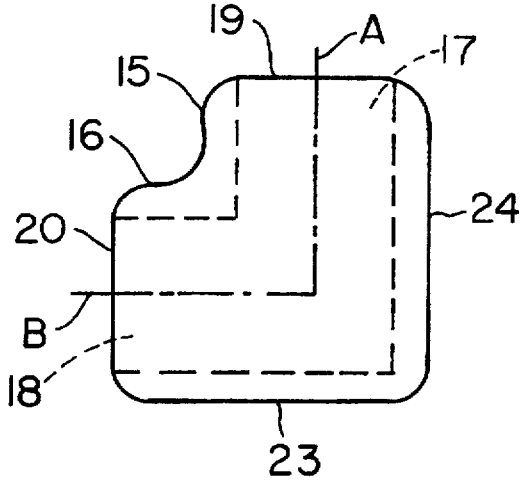
FIG. 4 is a side view of the corner protector of FIG. 3.

When viewed from the side as in FIG. 4, each of the wall sections 25,26 has a roughly S-shaped outline, and the wall sections 25,26 merge into the end faces 19,20 via externally curved surfaces of the corner protector 13. On the other hand, when viewed from one end as in FIG. 3 or, alternatively, when viewed in a plane normal to the cutout 27, each of the wall sections 25,26 resembles a segment of a curved arch.

The cutout 27 defines a vertical plane P which bisects the cutout 27 widthwise and contains the longitudinal axis of the cutout 27. The plane P also contains the longitudinal axes A,B of the channels 17,18 and is thus identical to the plane defined by the axes A,B.

At the outer periphery of the corner protector 13, the cutout 27 is bounded by an edge 28 of the wall section 25 and an edge 29 of the wall section 26. The edges 28,29 extend longitudinally of the cutout 27 and are parallel to one another. The wall section 25 is designed in such a manner that a tangent T1 to the upper surface of the wall section 25 at the edge 28 defines an obtuse angle $\alpha$ with the plane P. Likewise, the wall section 26 is designed so that a tangent T2 to the upper surface of the wall section 26 at the edge 29 defines an obtuse angle with the plane P. By virtue of this construction, the tangents T1,T2 will define obtuse angles with the cathode 2 when the cathode 2 is received in the cutout 27. This means that the upper surfaces of the wall sections 25,26 slope away from the cathode 2 adjacent the latter thereby making it easier to clean the area around the cathode 2.

The edge strips 8,9,10 and the corner protectors 13,14 can be made of any material conventionally employed for edge strips. Preferably, the edge strips 8,9,10 and the corner protectors 13,14 are composed of plastic.

The channels 17,18 are advantageously designed to frictionally engage the edge strips 8,9,10. Similarly, it is of advantage for the cutouts 27 of the corner protectors 13,14 to exert a gripping action on the cathode 2.

The preferred manner of assembling the electrode assembly 1 is as follows:

Adhesive is applied to the side edge strips 8,9 which are then pushed onto the edges 3,4 of the cathode 2 and properly adjusted. Adhesive is also applied to the channels 17,18 and the cutouts 27 of the corner protectors 13,14 as well as to the bottom edge strip 10. One end of the bottom edge strip 10 is thereupon inserted in the channel 18 of the corner protector 13 while the other end of the bottom edge strip 10 is inserted in the channel 18 of the corner protector 14. The unit consisting of the bottom edge strip 10 and the corner protectors 13,14 is now positioned with the channels 17 of the corner protectors 13,14 in register with the side edge strips 8,9. Once the unit 10,13,14 has been positioned in this manner, the unit 10,13,14 is moved towards the cathode 2 so that the side edge strips 8,9 enter the channels 17, the cathode 2 enters the cutouts 27 and the bottom edge strip 10 is pushed onto the bottom edge 5 of the cathode 2. The adhesive used in the electrode assembly 1 may be the same as that in conventional electrode assemblies.

The corner protectors 13,14 of the invention shield the junction lines 11,12 from the relatively harsh conditions, including exposure to electrolyte, existing in electrolytic processing installations. As a result, the junction lines 11,12 will degrade much less rapidly thereby allowing maintenance costs to be reduced. Furthermore, because of the shielding effect provided by the corner protectors 13,14, the side edge strips 8,9 need not fit against the bottom edge strip 10 with a high degree of precision. This makes it unnecessary to miter or otherwise specially machine the edge strips 8,9,10, or to accurately adjust the side edge strips 8,9 relative to the bottom edge strip 10. The corner protectors 13,14 also provide an extra layer of insulating material between the cathode 2 and its neighboring anodes thus additionally reducing the likelihood of contact.

Various modifications are possible within the meaning and range of equivalence of the appended claims.

We claim:

1. A corner protector for an electrolytic electrode having first and second edges which define a corner and are respectively provided with first and second coverings, said corner protector comprising:

a body provided with a first channel portion for receiving the first covering and a second channel portion for receiving the second covering, said body also being provided with a cutout for receiving the electrode.

2. The corner protector of claim 1, wherein said cutout opens to said channel portions.

3. The corner protector of claim 1, wherein said first channel portion has a first longitudinal axis and said second channel portion has a second longitudinal axis which intersects said first longitudinal axis.

4. The corner protector of claim 3, wherein said first longitudinal axis and said second longitudinal axis intersect one another at an angle of substantially 90 degrees.

5. The corner protector of claim 3, wherein said cutout has a third longitudinal axis which is substantially coplanar with said first and second longitudinal axes.

6. The corner protector of claim 1, wherein said first and second channel portions open to one another.

7. The corner protector of claim 1, wherein said first channel portion has a first opening in a first plane and said second channel portion has a second opening in a second plane which intersects said first plane.

8. The corner protector of claim 7, wherein said first and second planes are substantially perpendicular to one another.

9. The corner protector of claim 7, wherein said cutout extends from said first opening to said second opening.

10. The corner protector of claim 1, wherein said body is generally L-shaped and has a first leg and a second leg, said first channel portion extending along said first leg and said second channel portion extending along said second leg.

11. The corner protector of claim 1, wherein said body is of one piece.

12. The corner protector of claim 1, wherein said first channel portion has a cross-sectional shape essentially identical to that of the first covering and said second channel portion has a cross-sectional shape essentially identical to that of the second covering.

13. The corner protector of claim 12, wherein said first channel portion has a cross-sectional area equal or approximately equal to that of the first covering and said second channel portion has a cross-sectional area equal or approximately equal to that of the second covering.

14. The corner protector of claim 1, wherein said cutout defines a plane and has an external edge which extends longitudinally of said cutout, said body having an external surface portion which is bounded by said edge, and a tangent to said external surface portion at said edge defining an angle greater than 90 degrees with said plane.

15. The corner protector of claim 1, wherein said cutout is slot-like.

16. A method of making an electrolytic electrode assembly comprising the steps of:

providing an electrode having a first edge, and a second edge which defines an intersection with said first edge;

placing a first covering having a first end over said first edge so that said first end is in the region of said intersection;

placing a second covering having a second end over said second edge so that said second end is in the region of said intersection; and confining said first end, said second end and said intersection in an additional covering.

17. The method of claim 16, wherein the confining step comprises gripping said electrode with said additional covering.

18. The method of claim 16, wherein the confining step comprises gripping said first and second ends with said additional covering.

19. The method of claim 16, wherein the placing steps comprise abutting one of said ends against the other of said ends.

20. The method of claim 16, further comprising the step of adhesively connecting said additional covering to said first end, said second end and said electrode.

* * * * *